US008669719B2

(12) United States Patent
Sun et al.

(10) Patent No.: US 8,669,719 B2
(45) Date of Patent: Mar. 11, 2014

(54) LIGHT-EMITTING SYSTEM HAVING A LUMINOUS FLUX CONTROL DEVICE

(75) Inventors: Tai-Ping Sun, Jhongli (TW); Chia-Hung Wang, Taichung (TW); Li-Wen Mao, Puli Township (TW)

(73) Assignee: National Chi Nan University, Nantou (TW)

( * ) Notice: Subject to any disclaimer, the term of this patent is extended or adjusted under 35 U.S.C. 154(b) by 194 days.

(21) Appl. No.: 13/433,544

(22) Filed: Mar. 29, 2012

(65) Prior Publication Data

US 2013/0076260 A1 Mar. 28, 2013

(30) Foreign Application Priority Data

Sep. 26, 2011 (TW) ..... 100134580

(51) Int. Cl.
*H05B 37/02* (2006.01)

(52) U.S. Cl.
USPC ..... 315/297; 315/291; 315/307; 315/309; 315/312

(58) Field of Classification Search
USPC ..... 315/149, 150, 209 R, 291, 297, 307, 315/309, 312
See application file for complete search history.

(56) References Cited

U.S. PATENT DOCUMENTS

| | | | | |
|---|---|---|---|---|
| 6,917,187 | B2 * | 7/2005 | Okubo et al. | 323/275 |
| 7,705,541 | B2 * | 4/2010 | Watanabe et al. | 315/150 |
| 2010/0156467 | A1 * | 6/2010 | Sun et al. | 326/96 |

* cited by examiner

*Primary Examiner* — Douglas W Owens
*Assistant Examiner* — Thai Pham
(74) *Attorney, Agent, or Firm* — Shook Hardy & Bacon LLP

(57) ABSTRACT

A light-emitting system includes first and second solid-state light-emitting components, a current source providing a constant current through the second solid-state light-emitting component, a first instrumentation amplifier detecting a second forward voltage across the second solid-state light-emitting component so as to generate a first detection voltage having a magnitude dependent on the second forward voltage, a compensation voltage module operable to generate a compensation voltage having a magnitude related to the second forward voltage according to the first detection voltage and two reference voltages, and a power control module detecting a first forward voltage across the first solid-state light-emitting component and providing a driving current therethrough that is dependent on the compensation voltage and the first forward voltage and that varies according to ambient temperature.

23 Claims, 6 Drawing Sheets

LIGHT-EMITTING SYSTEM HAVING A LUMINOUS FLUX CONTROL DEVICE

CROSS-REFERENCE TO RELATED APPLICATION

This application claims priority of Taiwanese Application No. 100134580, filed on Sep. 26, 2011.

BACKGROUND OF THE INVENTION

1. Field of the Invention

The present invention relates to a light-emitting system, more particularly to a light-emitting system having a luminous flux control device.

2. Description of the Related Art

The forward voltage of a light emitting diode (LED) is influenced by the ambient temperature. FIG. 1 shows a plot of luminous flux and forward voltage vs. ambient temperature obtained for the LED when the LED is driven by a continuous wave constant driving current. FIG. 2 shows a plot of luminous flux and forward voltage vs. ambient temperature obtained for the LED when the LED is driven by a non-continuous wave constant driving current. It is evident that a rise in the ambient temperature will cause the forward voltage to fall, such that the luminous flux, which is in a positive relation to the light emitting efficiency or a product of the forward voltage and the operating current, is in a negative relation to the ambient temperature. Hence, application of LED without implementation of luminous flux control may result in instability in the luminous flux of the LED.

Referring to FIG. 3, Taiwanese Patent Application No. 92107029 discloses a conventional luminous flux control circuit 1 for controlling a light emitting power and hence a luminous flux of an LED 15 (e.g., a laser light emitting diode) in an optical pick-up of an optical drive device. The conventional luminous flux control circuit 1 includes a detection module 10, a signal source 11, an integration module 12, and a driving module 13.

The detection module 10 is operable to receive light emitted from the LED 15 and to detect the light emitting power of the LED 15 so as to generate a detection voltage V3 having a magnitude that is in a positive relation to the light emitting power detected by the detection module 10. The light emitting power is defined by the equation of $P=V_F \times I$, where P, $V_F$, and I are the light emitting power, a forward voltage, and an operating current of the LED 15, respectively.

The detection module 10 includes a light detector 101 and a front-end amplifier 102. Since a description of the operations of these components may be found in the specification of the aforesaid Taiwanese Application, these components will not be described hereinafter for the sake of brevity.

The signal source 11 is operable to generate a reference voltage V1 that has a magnitude greater than that of the detection voltage V3 and dynamically configurable according to a target light emitting power.

The integration module 12 is connected electrically to the signal source 11 and the detection module 10 for respectively receiving the reference voltage V1 and the detection voltage V3 therefrom, and is operable to output an integration voltage V2 based on an integration of a difference between the reference voltage V1 and the detection voltage V3. When the detection voltage V3 is reduced as a result of a reduction in the light emitting power, the difference between the reference voltage V1 and the detection voltage V3 is increased, causing the integration voltage V2 to increase. On the other hand, when the detection voltage V3 is increased as a result of an increase in the light emitting power, the difference between the reference voltage V1 and the detection voltage V3 is decreased, causing the integration voltage V2 to decrease.

The driving module 13 is interconnected electrically between the integration module 12 and the LED 15, and is operable to generate and provide to the LED 15 the operating current having a magnitude that is in a positive relation to the integration voltage V2 so as to stabilize light emitting power and hence luminous flux of the LED 15. The driving module 13 includes an amplifier 131 having an adjustable gain, and a driving unit 132 electrically connected electrically to the amplifier 131. Since a description of the operations of these components may be found in the specification of the aforesaid Taiwanese Application, these components will not be described hereinafter for the sake of brevity.

When the forward voltage of the LED 15 is decreased as a result of an increase in the ambient temperature, the light emitting power is reduced, the detection voltage V3 generated by the detection module 10 is decreased while the reference voltage V1 remains unchanged, and the difference between the reference voltage V1 and the detection voltage V3 is thus increased such that the integration voltage V2 and hence the operating current are, as a result, increased. This increase in the operating current serves to compensate for the reduction in the forward voltage, thereby stabilizing the light emitting power and hence the luminous flux.

It can be understood from the above that the conventional luminous flux control circuit 1 stabilizes the light emitting power through adjusting the operating current according to variations in the detection voltage V3, which corresponds to variations in light detected by the light detector 101 of the detection module 10. However, since the LED 15 suffers from poor directivity, factors such as distance between and positions of the light detector 101 and the LED 15, ambient light pollution, and sensitivity of the light detector 101 may cause errors in stabilization of the light emitting power, such that the conventional luminous flux control circuit 1 may not be able to effectively stabilize the light emitting power and hence the luminous flux of the LED 15 in response to variations in the ambient temperature.

SUMMARY OF THE INVENTION

Therefore, an object of the present invention is to provide a light-emitting system capable of alleviating the aforesaid drawbacks of the prior art.

Accordingly, a light-emitting system with luminous flux stabilization of the present invention includes:

a first solid-state light-emitting component having an anode and a cathode, one of which is disposed to receive an input voltage, and having a first forward voltage when driven under a constant current condition; and a luminous flux control device including a second solid-state light-emitting component having an anode and a cathode, one of which is disposed to receive the input voltage, and having a second forward voltage when driven under a constant current condition, and a luminous flux control circuit including a detection module including a current source and a first instrumentation amplifier, the current source being connected electrically to the other of the anode and the cathode of the second solid-state light-emitting component for providing a constant current through the second solid-state light-emitting component, the first instrumentation amplifier having first and second input terminals that are connected electrically and respectively to the anode and the cathode of the second solid-state light-emitting component for detecting the second forward voltage, the first instrumentation amplifier being operable to generate a first detection voltage that has a magnitude dependent on the second forward voltage detected by the first instrumentation amplifier, and further having an output terminal for outputting the first detection voltage, a compensation voltage module connected electrically to the output terminal of the first instrumentation amplifier for receiving the first detection voltage from the first instrumentation amplifier, disposed to receive a first reference voltage and a second reference voltage, and operable to generate a compensation voltage according to the first detection voltage, the first reference voltage, and the second reference voltage received by the compensation voltage module, the compensation voltage having a magnitude related to the second forward voltage, and a power control module connected electrically to the compensation voltage module for receiving the compensation voltage from the compensation voltage module, connected electrically to the anode and the cathode of the first solid-state light-emitting component for detecting the first forward voltage, and operable to provide a driving current through the first solid-state light-emitting component, the driving current being dependent on the compensation voltage and the first forward voltage received and detected by the power control module and varying according to ambient temperature to stabilize luminous flux of the first solid-state light-emitting component.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
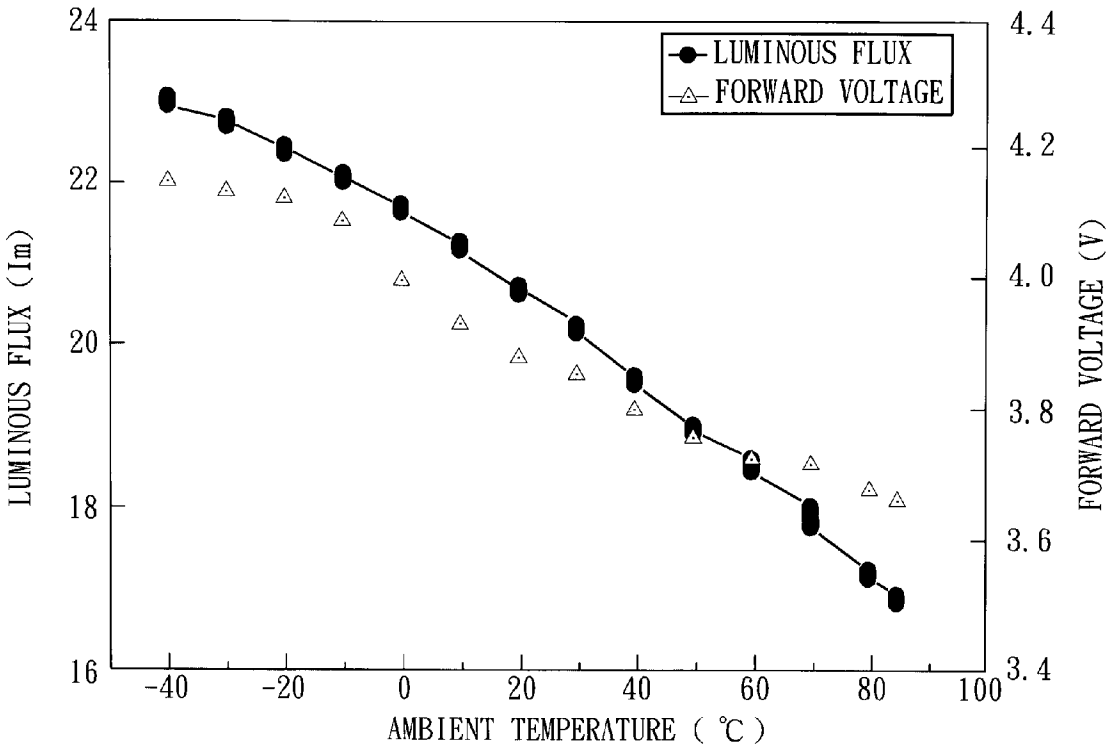
FIG. 1 PRIOR ART
FIG. 1 shows a plot of luminous flux and forward voltage vs. ambient temperature obtained for a light emitting diode (LED) driven by a continuous wave constant driving current.
Figure 2:
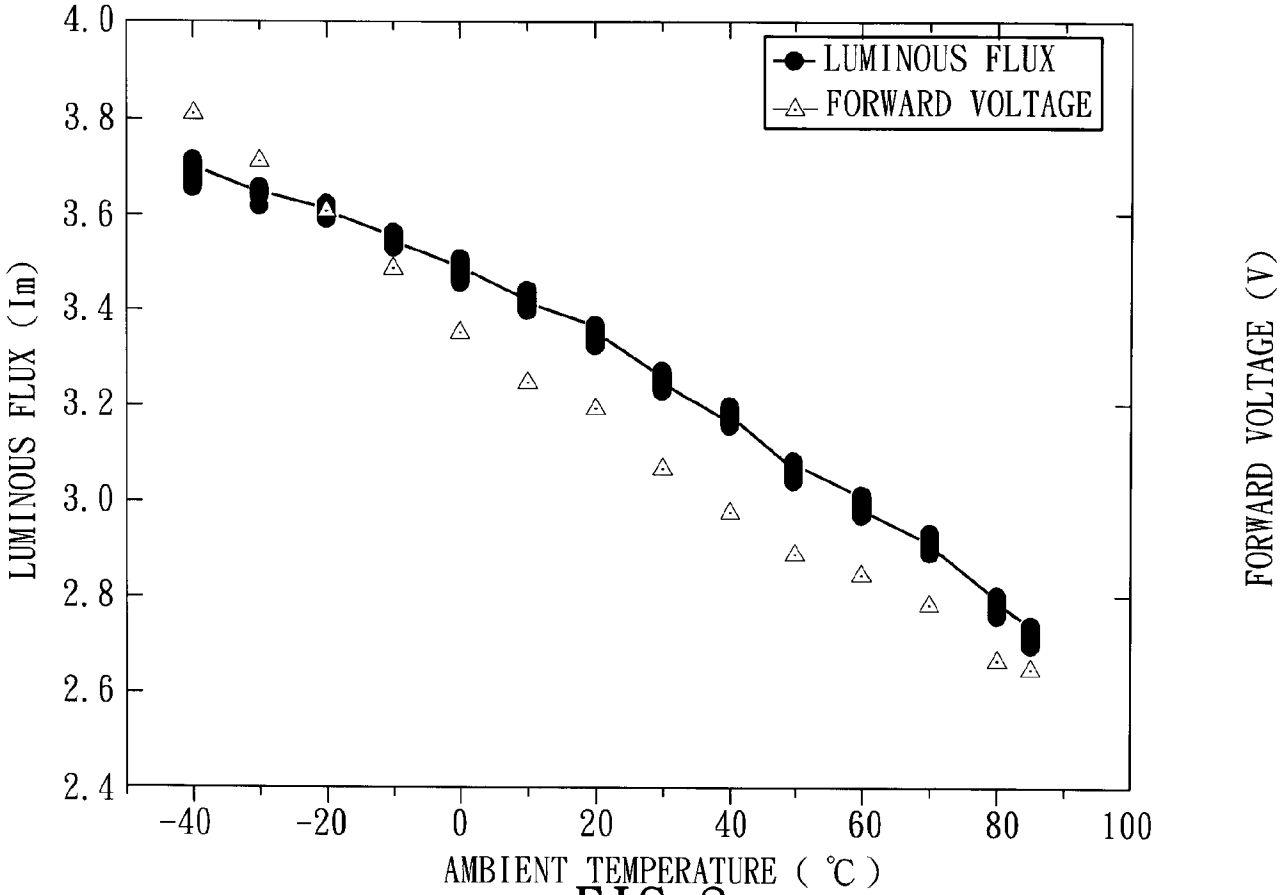
FIG. 2 PRIOR ART
FIG. 2 shows a plot of luminous flux and forward voltage vs. ambient temperature obtained for an LED driven by a pulse wave constant driving current.
Figure 3:
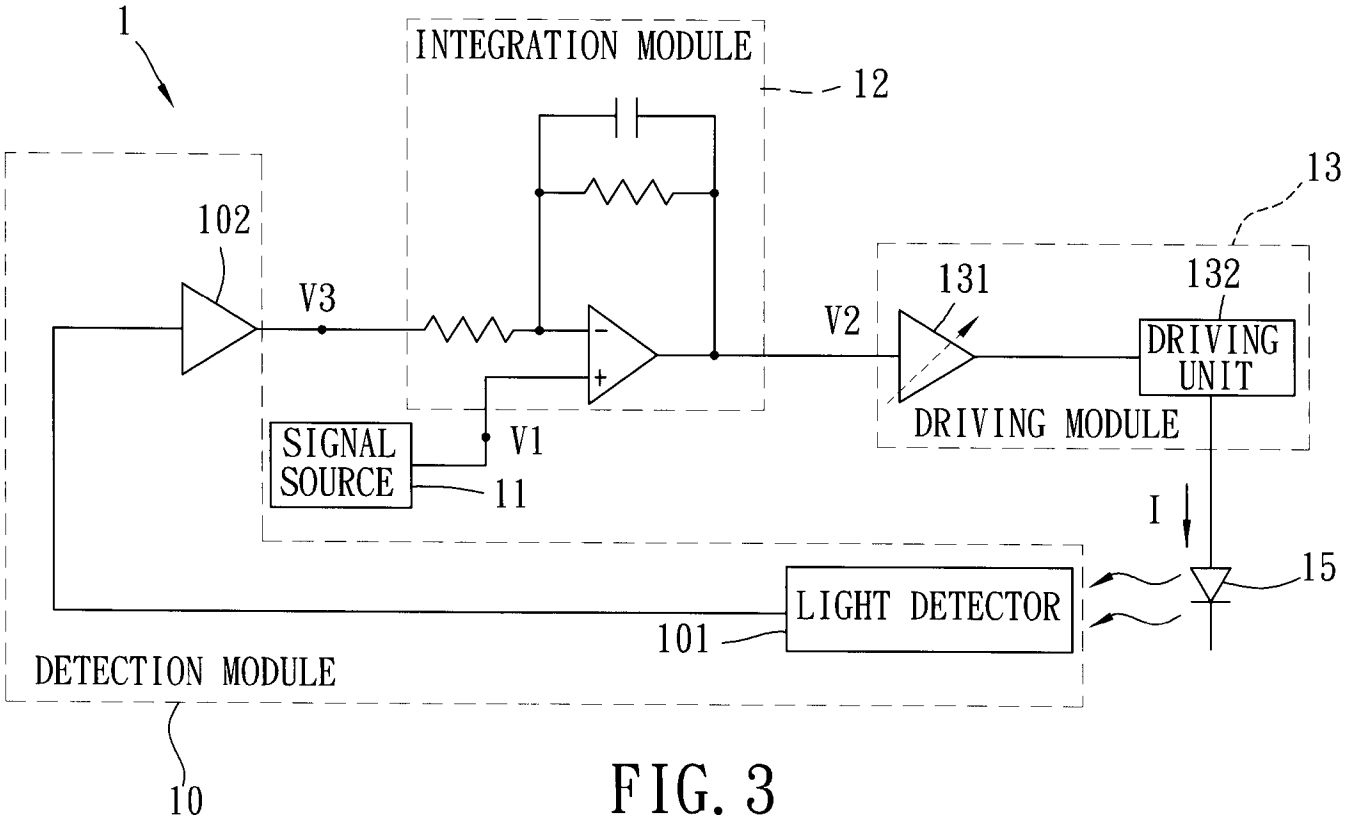
FIG. 3 PRIOR ART
FIG. 3 shows a schematic circuit block diagram of a conventional luminous flux control circuit.
Figure 4:
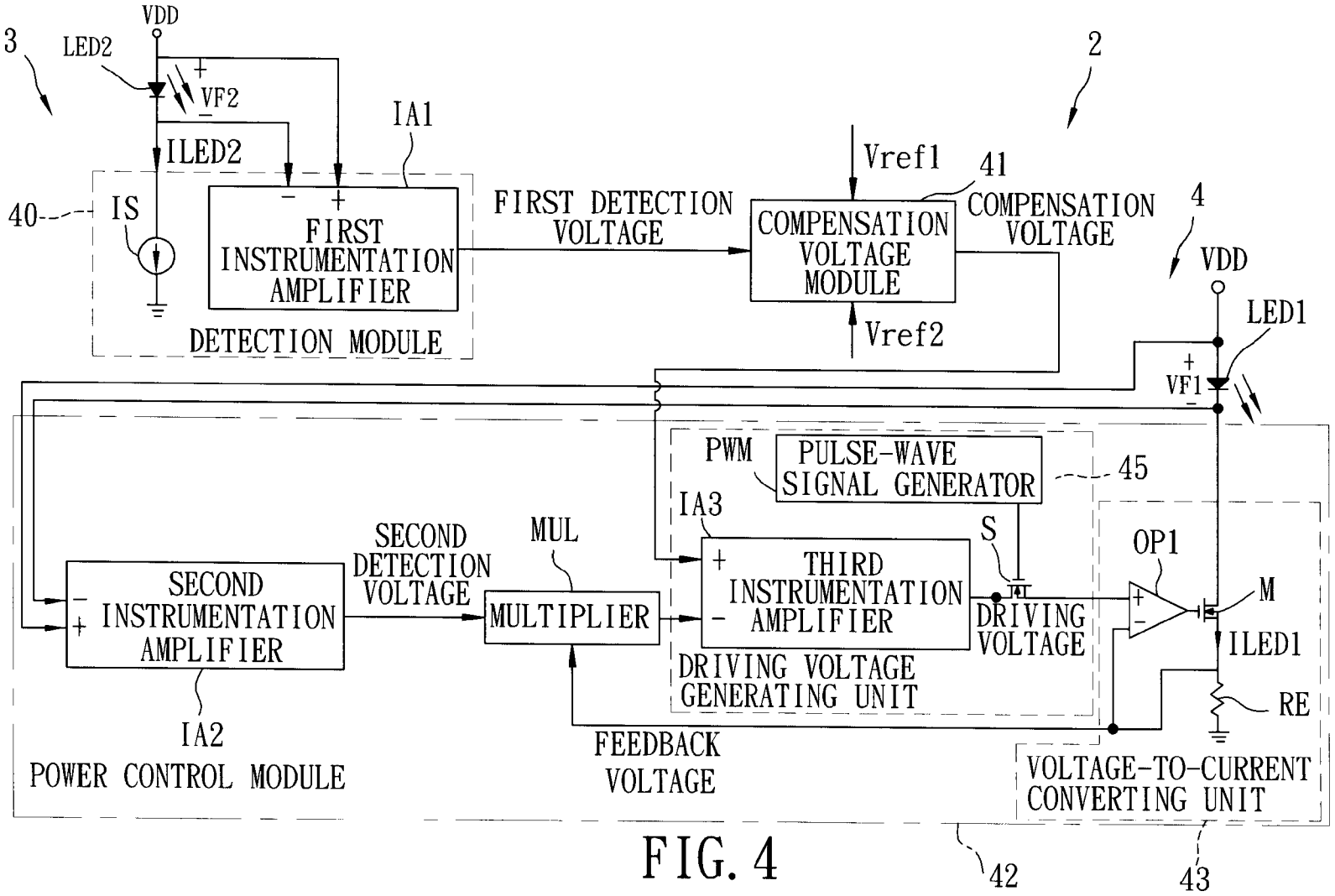
FIG. 4 shows a schematic circuit block diagram of the preferred embodiment of a light emitting system with luminous flux control, according to the present invention.

Referring to FIG. 4, the preferred embodiment of a light-emitting system 2 with luminous flux stabilization, according to the present invention, includes a first solid-state light-emitting component (LED1) and a luminous flux control device 3 connected electrically thereto.

The first solid-state light-emitting component (LED1) is a light-emitting diode lamp having an anode that is disposed to receive a bias voltage (VDD), and a cathode, and having a first forward voltage (VF1) that is in a negative relation to the ambient temperature when the first solid-state light-emitting component (LED1) is driven under a constant current condition.

The luminous flux control device 3 is operable to compensate the first solid-state light-emitting component (LED1) for variations in a light emitting power and hence variations in a luminous flux of the first solid-state light-emitting component (LED1) attributed to variations in the ambient temperature. The luminous flux control device 3 includes a second solid-state light-emitting component (LED2) and a luminous flux control circuit 4.

The second solid-state light-emitting component (LED2) is a light-emitting diode lamp having an anode that is disposed to receive the bias voltage (VDD), and a cathode, and having a second forward voltage (VF2) that is in a negative relation to the ambient temperature when the second solid-state light-emitting component (LED2) is driven under a constant current condition.

In this embodiment, the first solid-state light-emitting component (LED1) and the second solid-state light-emitting component (LED2) are characterized by substantially identical relationships between ambient temperature and forward voltage. Furthermore, the first solid-state light-emitting component (LED1) and the second solid-state light-emitting component (LED2) may be otherwise, such as laser diodes, in other embodiments.

The luminous flux control circuit 4 includes a detection module 40, a compensation voltage module 41, and a power control module 42.

The detection module 40 includes a current source (IS) connected electrically to the cathode of the second solid-state light-emitting component (LED2) for providing an operating current (ILED2) with a fixed magnitude (i.e., a constant current) through the second solid-state light-emitting component (LED2), and a first instrumentation amplifier (IA1) having non-inverting and inverting input terminals that are connected electrically and respectively to the anode and the cathode of the second solid-state light-emitting component (LED2) for detecting the second forward voltage (VF2). The first instrumentation amplifier (IA1) is operable to generate a first detection voltage that is in a positive relation to the second forward voltage (VF2) detected by the first instrumentation amplifier (IA1), and further has an output terminal for outputting the first detection voltage. In this embodiment, the first instrumentation amplifier (IA1) has unity gain, such that the first detection signal is substantially identical to the second forward voltage (VF2), which satisfies equation 1

$$VF2=V_{LED}+\Delta V_{LED} \quad (1)$$

where $V_{LED}$ represents a value of the second forward voltage (VF2) when the ambient temperature is equal to "t", and $\Delta V_{LED}$ represents a change in value of the second forward voltage (VF2) when a change in the ambient temperature is equal to "Δt". In this embodiment, "t" is equal to −40° C.

The compensation voltage module 41 is connected electrically to the output terminal of the first instrumentation amplifier (IA1) for receiving the first detection voltage therefrom, is disposed to receive a first reference voltage (Vref1) and a second reference voltage (Vref2), and is operable to generate a compensation voltage according to the first detection voltage, the first reference voltage, and the second reference voltage received by the compensation voltage module 41. The compensation voltage is in a negative relation to the second forward voltage (VF2), and satisfies equation 2

$$VC=G1\times(Vref1-Vdet1)+Vref2 \quad (2)$$

where VC represents the compensation voltage, G1 represents a gain of the compensation voltage module 41, and Vdet1 represents the first detection voltage. In this embodiment, since the first detection voltage is substantially identical to the second forward voltage (VF2), equation 2 may be rewritten as equation 2'

$$VC=G1\times(Vref1-VF2)+Vref2 \quad (2')$$

Furthermore, in this embodiment, the first reference voltage (Vref1) is set to be equal to the value of the second forward voltage (VF2) when the ambient temperature is equal to "t", i.e., Vref1=$V_{LED}$. Thus, equation 2' may be simplified into equation 3

$$\begin{aligned} VC &= G1\times(V_{LED}-VF2)+Vref2 \quad (3)\\ &= G1\times(V_{LED}-(V_{LED}+\Delta V_{LED}))+Vref2\\ &= -G1\times\Delta V_{LED}+Vref2 \end{aligned}$$

Next, when the change in value of the ambient temperature is equal to "Δt", a corresponding change in value of the compensation voltage satisfies equation 4 based on equations 1 and 2'

$$\begin{aligned} \Delta VC &= \{G1\times(Vref1(V_{LED}+\Delta V_{LED})+Vref2\}- \quad (4)\\ &\quad \{G1\times(Vref1-V_{LED})+Vref2\}\\ &= -G1\times\Delta V_{LED} \end{aligned}$$

where ΔVC represents the change in value of the compensation voltage.

The power control module 42 is connected electrically to the compensation voltage module 41 for receiving the compensation voltage therefrom, is connected electrically to the anode and the cathode of the first solid-state light-emitting component (LED1) for detecting the first forward voltage (VF1), and is operable to provide a driving current (ILED1) through the first solid-state light-emitting component (LED1). The driving current (ILED1) is dependent on the compensation voltage and the first forward voltage (VF1) received and detected by the power control module 42 and varies according to the ambient temperature to stabilize the luminous flux of the first solid-state light-emitting component (LED1).

The power control module 42 includes a voltage-to-current converting unit 43, a second instrumentation amplifier (IA2), a multiplier (MUL), and a driving voltage generating unit 45.

The voltage-to-current converting unit 43 is connected electrically to the cathode of the first solid-state light-emitting component (LED1), and is operable to provide the driving current (ILED1) through the first solid-state light-emitting component (LED1) according to a driving voltage received by the voltage-to-current converting unit 43, and to generate a feedback voltage according to the driving current (ILED1) provided by the voltage-to-current converting unit 43. In this embodiment, the driving current (ILED1) is in a positive relation to the driving voltage. The voltage-to-current converting unit 43 includes a transistor (M), an operational amplifier (OP1), and a resistor (RE).

The transistor (M) has a first terminal connected electrically to the cathode of the first solid-state light-emitting component (LED1), a second terminal connected to ground via the resistor (RE), and a control terminal. In this embodiment, a voltage at the second terminal of the transistor (M) serves as the feedback voltage. Moreover, the transistor (M) is an N-type metal-oxide-semiconductor field-effect transistor (MOSFET) having a drain terminal, a source terminal, and a gate terminal serving as the first terminal, the second terminal, and the control terminal of the transistor (M), respectively.

The operational amplifier (OP1) has a non-inverting input terminal for receiving the driving voltage, and an inverting input terminal connected electrically to the second terminal of the transistor (M) for receiving the feedback voltage from the transistor (M), is operable to generate a control voltage according to a difference between the driving voltage and the feedback voltage received by the operational amplifier (OP1), and further has an output terminal connected electrically to the control terminal of the transistor (M) for outputting the control voltage to the transistor (M), such that the transistor (M) turns on to control provision of the driving current (ILED1) through the first solid-state light-emitting component (LED1) via the transistor (M) according to the control voltage.

The resistor (RE) has a resistance value of $R_E$, and has a first terminal connected electrically to the second terminal of the transistor (M), and a grounded second terminal. Thus, the feedback voltage equals to a voltage across the resistor (RE), or a product of the driving current (ILED1) and the resistance value of the resistor (RE), i.e., VRE=ILED1×$R_E$, where VRE is the voltage across the resistor (RE). Furthermore, the driving current (ILED1) is equal to a result of division of the driving voltage by the resistance value of the resistor (RE) because of a virtual short circuit effect between the inverting and non-inverting input terminals of the operational amplifier (OP1).

The second instrumentation amplifier (IA2) has a non-inverting input terminal and an inverting input terminal connected electrically and respectively to the anode and the cathode of the first solid-state light-emitting component (LED1) for detecting the first forward voltage (VF1), is operable to generate a second detection voltage according to the first forward voltage (VF1) detected by the second instrumentation amplifier (IA2), and further has an output terminal for outputting the second detection voltage. The second detection voltage is in a positive relation to the first forward voltage (VF1).

The multiplier (MUL) is connected electrically to the output terminal of the second instrumentation amplifier (IA2) for receiving the second detection voltage therefrom, is connected electrically to the voltage-to-current converting unit 43 for receiving the feedback voltage therefrom, and is operable to generate a product voltage that satisfies equation 5 based on a product of the second detection voltage and the feedback voltage received by the multiplier (MUL)

$$VMUX=Vdet2\times VRE \quad (5)$$

where VMUX represents the product voltage, Vdet2 represents the second detection voltage, and VRE represents the feedback voltage, which is the voltage across the resistor (RE).

In this embodiment, the second instrumentation amplifier (IA2) has unity gain, such that the second detection voltage is substantially identical to the first forward voltage (VF1). Hence, equation 5 may be rewritten as equation 5'

$$VMUX = VF1 \times VRE \quad (5')$$
$$= (V_{LED} + \Delta V_{LED}) \times (ILED1 \times R_E)$$

The driving voltage generating unit 45 is connected electrically to the compensation voltage module 41 and the multiplier (MUL) for respectively receiving the compensation voltage and the product voltage therefrom, is operable to generate the driving voltage according to a difference between the compensation voltage and the product voltage received by the driving voltage generating unit 45, and is connected electrically to the non-inverting terminal of the operational amplifier (OP1) for providing the driving voltage to the operational amplifier (OP1). The driving voltage satisfies equation 6

$$VD = VC - VMUX \quad (6)$$
$$= (-G1 \times \Delta V_{LED} + Vref2) - (V_{LED} + \Delta V_{LED}) \times (ILED1 \times R_E)$$

where VD represents the driving voltage. Next, equation 7 may be obtained by substituting VD=ILED1×$R_E$ into equation 6

$$ILED1 = \frac{(-G1 \times \Delta V_{LED} + Vref2)}{(1 + V_{LED} + \Delta V_{LED}) \times R_E} \quad (7)$$

It can be understood from equation 7 that, when the ambient temperature rises, the variation in value of the second forward voltage (VF2) is negative (i.e., $\Delta V_{LED}<0$), causing the second forward voltage (VF2) to decrease, which, in turn, causes the driving current (ILED1) to increase. On the other hand, when the ambient temperature falls, the variation in value of the second forward voltage (VF2) is positive (i.e., $\Delta V_{LED}>0$), causing the second forward voltage (VF2) to increase, which, in turn, causes the driving current (ILED1) to decrease. Thus, the driving current (ILED1) varies according to the ambient temperature to achieve stabilization of light emitting power and hence luminous flux of the first solid-state light-emitting component (LED1).

The driving voltage generating unit 45 includes a third instrumentation amplifier (IA3), a pulse-wave signal generator (PWM), and a switch (S).

The third instrumentation amplifier (IA3) has a non-inverting input terminal connected electrically to the compensation voltage module 41 for receiving the compensation voltage from the compensation voltage module 41, and an inverting input terminal connected electrically to the multiplier (MUL) for receiving the product voltage from the multiplier (MUL), is operable to generate the driving voltage according to the compensation voltage and the product voltage received by the third instrumentation amplifier (IA3), and further has an output terminal for outputting the driving voltage. In this embodiment, the third instrumentation amplifier (IA3) has unity gain.

The pulse-wave signal generator (PWM) is operable to generate a pulse-wave modulation signal with a duty ratio that is adjustable.

The switch (S) has a first terminal connected electrically to the output terminal of the third instrumentation amplifier (IA3), a second terminal connected electrically to the non-inverting terminal of the operational amplifier (OP1), and a control terminal connected electrically to the pulse-wave signal generator (PWM) for receiving the pulse-wave modulation signal therefrom, such that the switch (S) is turned on to control provision of the driving voltage from the output terminal of the third instrumentation amplifier (IA3) to the non-inverting terminal of the operational amplifier (OP1) via the switch (S) according to the pulse-wave modulation signal received by the switch (S). The duty cycle of the pulse-wave modulation signal may be adjusted according to need such that each of the driving voltage and hence the driving current (ILED1), has one of a continuous waveform and a pulse waveform, which correspond to a duty cycle of 100% and a duty cycle of less than 100% (e.g., 10%), respectively. In this embodiment, the switch (S) is an N-type MOSFET having a drain terminal, a source terminal, and a gate terminal that serve as the first terminal, the second, terminal, and the control terminal of the switch (S), respectively.

Figure 5:
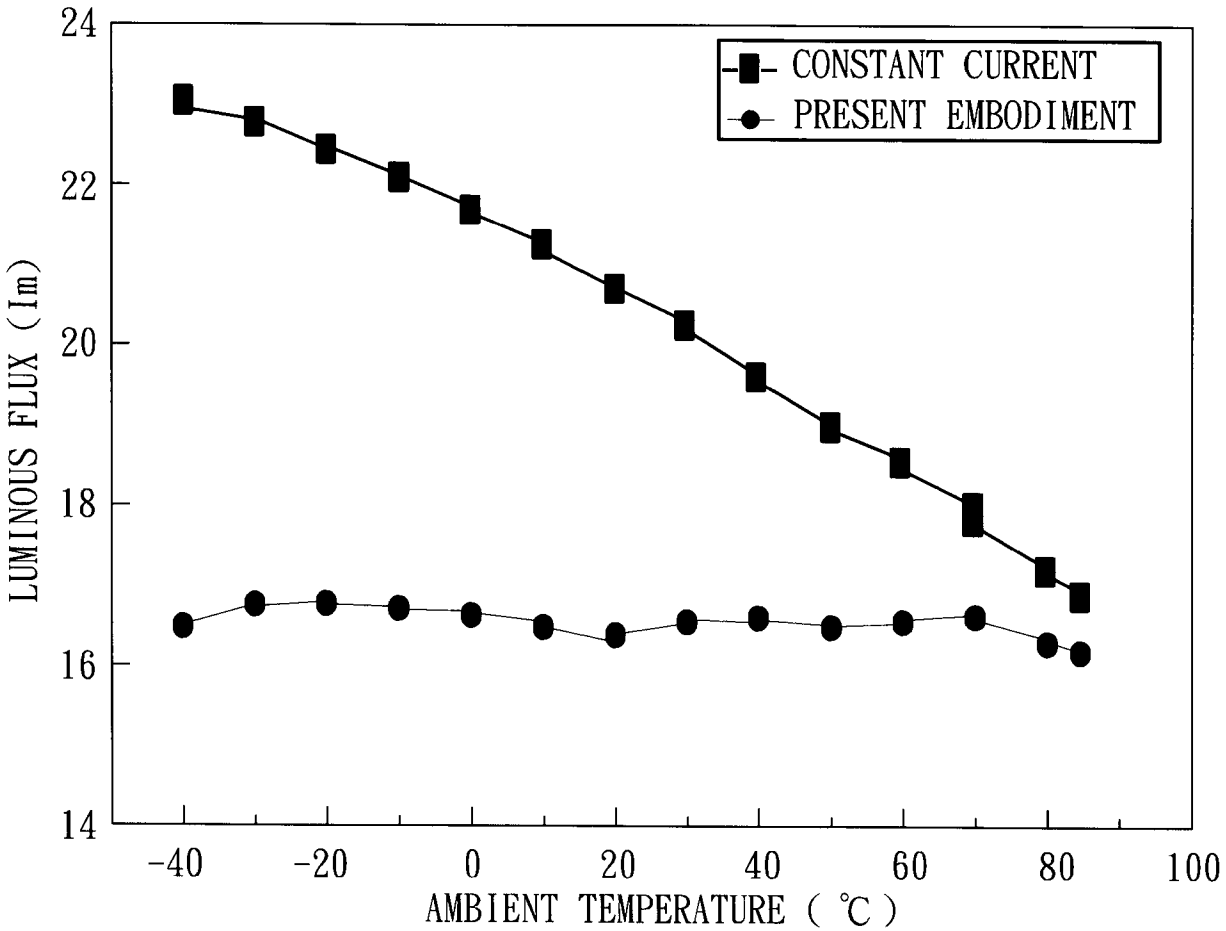
FIG. 5 shows a plot of luminous flux vs. ambient temperature obtained for a solid-state light-emitting component of the light emitting system when the solid-state light-emitting component is driven by a continuous wave driving current provided by a luminous flux control device of the light emitting system.

FIG. 5 shows plots of luminous flux vs. ambient temperature obtained for a white light LED within an ambient temperature range of −40° C. to 80° C. when the white light LED is driven by a continuous wave driving current from the luminous flux control device 3 of the preferred embodiment and by a continuous wave constant current from a conventional luminous flux control device, respectively.

Figure 6:
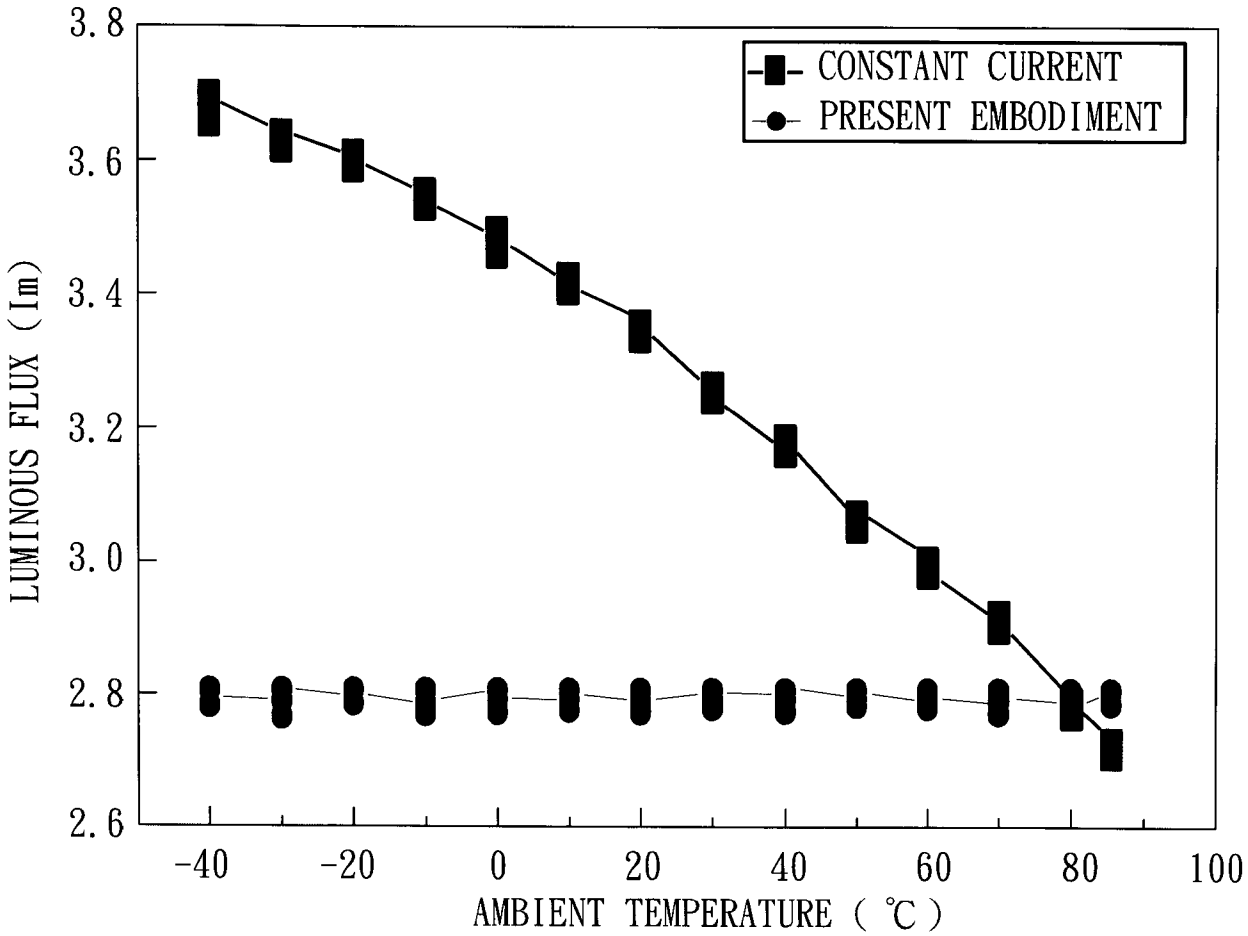
FIG. 6 shows a plot of luminous flux vs. ambient temperature obtained for the solid-state light-emitting component of the light emitting system when the solid-state light-emitting component is driven a pulse wave driving current provided by the luminous flux control device of the light emitting system.

FIG. 6 shows plots of luminous flux vs. ambient temperature obtained for a white light LED within an ambient temperature range of −40° C. to 80° C. when the white light LED is driven by a pulse wave driving current from the luminous flux control device 3 of the preferred embodiment and by a pulse wave constant current from a conventional luminous flux control device, respectively.

In summary, since variations in the second forward voltage (VF2) correspond to variations in the ambient temperature, through detecting the second forward voltage (VF2) using the detection module 40, the luminous flux control device 3 is able to stabilize luminous flux of the first solid-state light-emitting component (LED1) according to variations in the second forward voltage (VF2) detected by the detection module 40, which alleviates the aforesaid drawbacks of the prior art. Moreover, since the duty cycle of the pulse wave modulation signal may be adjusted, the duration during which the first solid-state light-emitting component (LED1) emits light may be shortened, thereby reducing heat generated by the first solid-state light-emitting component (LED1), which further stabilizes the luminous flux.

While the present invention has been described in connection with what is considered the most practical and preferred embodiment, it is understood that this invention is not limited to the disclosed embodiment but is intended to cover various arrangements included within the spirit and scope of the broadest of the broadest interpretation so as to encompass all such modifications and equivalent arrangements.

What is claimed is:

1. A light-emitting system with luminous flux stabilization comprising:

a first solid-state light-emitting component having an anode and a cathode, one of which is disposed to receive an input voltage, and having a first forward voltage when driven under a constant current condition; and a luminous flux control device including a second solid-state light-emitting component having an anode and a cathode, one of which is disposed to receive the input voltage, and having a second forward voltage when driven under a constant current condition, and a luminous flux control circuit including a detection module including a current source and a first instrumentation amplifier, said current source being connected electrically to the other of said anode and said cathode of said second solid-state light-emitting component for providing a constant current through said second solid-state light-emitting component, said first instrumentation amplifier having first and second input terminals that are connected electrically and respectively to said anode and said cathode of said second solid-state light-emitting component for detecting the second forward voltage, said first instrumentation amplifier being operable to generate a first detection voltage that has a magnitude dependent on the second forward voltage detected by said first instrumentation amplifier, and further having an output terminal for outputting the first detection voltage, a compensation voltage module connected electrically to said output terminal of said first instrumentation amplifier for receiving the first detection voltage from said first instrumentation amplifier, disposed to receive a first reference voltage and a second reference voltage, and operable to generate a compensation voltage according to the first detection voltage, the first reference voltage, and the second reference voltage received by said compensation voltage module, the compensation voltage having a magnitude related to the second forward voltage, and a power control module connected electrically to said compensation voltage module for receiving the compensation voltage from said compensation voltage module, connected electrically to said anode and said cathode of said first solid-state light-emitting component for detecting the first forward voltage, and operable to provide a driving current through said first solid-state light-emitting component, the driving current being dependent on the compensation voltage and the first forward voltage received and detected by said power control module and varying according to ambient temperature to stabilize luminous flux of said first solid-state light-emitting component.

2. The light-emitting system as claimed in claim 1, wherein said power control module includes:

a voltage-to-current converting unit connected electrically to the other of said anode and said cathode of said first solid-state light-emitting component, and operable to provide the driving current through said first solid-state light-emitting component according to a driving voltage received by said voltage-to-current converting unit, and to generate a feedback voltage according to the driving current provided thereby;

a second instrumentation amplifier having first and second input terminals that are connected electrically and respectively to said anode and said cathode of said first solid-state light-emitting component for detecting the first forward voltage, operable to generate a second detection voltage that has a magnitude dependent on the first forward voltage detected by said second instrumentation amplifier, and further having an output terminal for outputting the second detection voltage;

a multiplier connected electrically to said output terminal of said second instrumentation amplifier for receiving the second detection voltage from said second instrumentation amplifier, connected electrically to said voltage-to-current converting unit for receiving the feedback voltage from said voltage-to-current converting unit, and operable to generate a product voltage based on a product of the second detection voltage and the feedback voltage received by said multiplier; and a driving voltage generating unit connected electrically to said compensation voltage module for receiving the compensation voltage from said compensation voltage module, connected electrically to said multiplier for receiving the product voltage from said multiplier, operable to generate the driving voltage according to a difference between the compensation voltage and the product voltage, and connected electrically to said voltage-to-current converting unit for providing the driving voltage to said voltage-to-current converting unit.

3. The light-emitting system as claimed in claim 2, wherein said voltage-to-current converting unit includes:

a resistor;

a transistor having a first terminal connected electrically to the other of said anode and said cathode of said first solid-state light-emitting component, a second terminal connected to ground via said resistor, and a control terminal, a voltage at said second terminal of said transistor serving as the feedback voltage; and an operational amplifier that has a first input terminal connected electrically to said driving voltage generating unit for receiving the driving voltage from said driving voltage generating unit, and a second input terminal connected electrically to said second terminal of said transistor for receiving the feedback voltage from said transistor, that is operable to generate a control voltage according to a difference between the driving voltage and the feedback voltage, and that further has an output terminal connected electrically to said control terminal of said transistor for outputting the control voltage to said transistor, such that said transistor is turned on to control provision of the driving current through said first solid-state light-emitting component via said transistor according to the control voltage received by said transistor.

4. The light-emitting system as claimed in claim 3, wherein said transistor is an n-type metal-oxide-semiconductor field-effect transistor having a drain terminal, a source terminal, and a gate terminal that serve as said first terminal, said second terminal, and said control terminal of said transistor, respectively.

5. The light-emitting system as claimed in claim 2, wherein said driving voltage generating unit includes:

a third instrumentation amplifier that has a first input terminal connected electrically to said compensation voltage module for receiving the compensation voltage from said compensation voltage module, and a second input terminal connected electrically to said multiplier for receiving the product voltage from said multiplier, that is operable to generate the driving voltage according to the compensation voltage and the product voltage received by said third instrumentation amplifier, and that has an output terminal for outputting the driving voltage;

a pulse-wave signal generator operable for generating a pulse-wave modulation signal; and a switch that has a first terminal connected electrically to said output terminal of said third instrumentation amplifier, a second terminal connected electrically to said voltage-to-current converting unit, and a control terminal connected electrically to said pulse-wave signal generator for receiving the pulse-wave modulation signal from said pulse-wave signal generator, such that said switch is turned on to control provision of the driving voltage from said output terminal of said third instrumentation amplifier to said voltage-to-current converting unit via said switch according to the pulse-wave modulation signal received by said switch.

6. The light-emitting system as claimed in claim 5, wherein said switch is an n-type metal-oxide-semiconductor field-effect transistor having a drain terminal, a source terminal, and a gate terminal that serve as said first terminal, said second terminal, and said control terminal of said switch, respectively.

7. The light-emitting system as claimed in claim 1, wherein the compensation voltage generated by said compensation voltage module satisfies $$VC=G1\times(Vref1-Vdet1)+Vref2$$

where VC represents the compensation voltage, G1 represents a gain of said compensation voltage module, Vref1 represents the first reference voltage, Vdet1 represents the first detection voltage, and Vref2 represents the second reference voltage.

8. The light-emitting system as claimed in claim 1, wherein each of said first and second solid-state light-emitting components is one of a light-emitting diode and a laser diode.

9. A luminous flux control device adapted to be connected to a first solid-state light-emitting component that has an anode and a cathode, one of which is disposed to receive an input voltage, and that has a first forward voltage when driven under a constant current condition, said luminous flux control device comprising:

a second solid-state light-emitting component having an anode and a cathode, one of which is disposed to receive the input voltage, and having a second forward voltage when driven under a constant current condition; and a luminous flux control circuit including a detection module including a current source and a first instrumentation amplifier, said current source being connected electrically to the other of said anode and said cathode of said second solid-state light-emitting component for providing a constant current through said second solid-state light-emitting component, said first instrumentation amplifier having first and second input terminals that are connected electrically and respectively to said anode and said cathode of said second solid-state light-emitting component for detecting the second forward voltage, said first instrumentation amplifier being operable to generate a first detection voltage that has a magnitude dependent on the second forward voltage detected by said first instrumentation amplifier, and further having an output terminal for outputting the first detection voltage, a compensation voltage module connected electrically to said output terminal of said first instrumentation amplifier for receiving the first detection voltage from said first instrumentation amplifier, disposed to receive a first reference voltage and a second reference voltage, and operable to generate a compensation voltage according to the first detection voltage, the first reference voltage, and the second reference voltage received by said compensation voltage module, the compensation voltage having a magnitude related to the second forward voltage, and a power control module connected electrically to said compensation voltage module for receiving the compensation voltage from said compensation voltage module, adapted to be connected electrically to the anode and the cathode of the first solid-state light-emitting component for detecting the first forward voltage, and operable to provide a driving current through the first solid-state light-emitting component, the driving current being dependent on the compensation voltage and the first forward voltage received and detected by said power control module and varying according to ambient temperature to stabilize luminous flux of the first solid-state light-emitting component.

10. The luminous flux control device as claimed in claim 9, wherein said power control module includes:

a voltage-to-current converting unit adapted to be connected electrically to the other of the anode and the cathode of the first solid-state light-emitting component, and operable to provide the driving current through the first solid-state light-emitting component according to a driving voltage received by said voltage-to-current converting unit, and to generate a feedback voltage according to the driving current provided thereby;

a second instrumentation amplifier having first and second input terminals that are adapted to be connected electrically and respectively to the anode and the cathode of the first solid-state light-emitting component for detecting the first forward voltage, operable to generate a second detection voltage that has a magnitude dependent on the first forward voltage detected by said second instrumentation amplifier, and further having an output terminal for outputting the second detection voltage;

a multiplier connected electrically to said output terminal of said second instrumentation amplifier for receiving the second detection voltage from said second instrumentation amplifier, connected electrically to said voltage-to-current converting unit for receiving the feedback voltage from said voltage-to-current converting unit, and operable to generate a product voltage based on a product of the second detection voltage and the feedback voltage received by said multiplier; and a driving voltage generating unit connected electrically to said compensation voltage module for receiving the compensation voltage from said compensation voltage module, connected electrically to said multiplier for receiving the product voltage from said multiplier, operable to generate the driving voltage according to a difference between the compensation voltage and the product voltage, and connected electrically to said voltage-to-current converting unit for providing the driving voltage to said voltage-to-current converting unit.

11. The luminous flux control device as claimed in claim 10, wherein said voltage-to-current converting unit includes:

a resistor;

a transistor having a first terminal adapted to be connected electrically to the other of the anode and the cathode of the first solid-state light-emitting component, a second terminal connected to ground via said resistor, and a control terminal, a voltage at said second terminal of said transistor serving as the feedback voltage; and an operational amplifier that has a first input terminal connected electrically to said driving voltage generating unit for receiving the driving voltage from said driving voltage generating unit, and a second input terminal connected electrically to said second terminal of said transistor for receiving the feedback voltage from said transistor, that is operable to generate a control voltage according to a difference between the driving voltage and the feedback voltage, and that further has an output terminal connected electrically to said control terminal of said transistor for outputting the control voltage to said transistor, such that said transistor is turned on to control provision of the driving current through the first solid-state light-emitting component via said transistor according to the control voltage received by said transistor.

12. The luminous flux control device as claimed in claim 11, wherein said transistor is an n-type metal-oxide-semiconductor field-effect transistor having a drain terminal, a source terminal, and a gate terminal that serve as said first terminal, said second terminal, and said control terminal of said transistor, respectively.

13. The luminous flux control device as claimed in claim 10, wherein said driving voltage generating unit includes:

a third instrumentation amplifier that has a first input terminal connected electrically to said compensation voltage module for receiving the compensation voltage from said compensation voltage module, and a second input terminal connected electrically to said multiplier for receiving the product voltage from said multiplier, that is operable to generate the driving voltage according to the compensation voltage and the product voltage received by said third instrumentation amplifier, and that has an output terminal for outputting the driving voltage;

a pulse-wave signal generator operable for generating a pulse-wave modulation signal; and a switch that has a first terminal connected electrically to said output terminal of said third instrumentation amplifier, a second terminal connected electrically to said voltage-to-current converting unit, and a control terminal connected electrically to said pulse-wave signal generator for receiving the pulse-wave modulation signal from said pulse-wave signal generator, such that said switch is turned on to control provision of the driving voltage from said output terminal of said third instrumentation amplifier to said voltage-to-current converting unit via said switch according to the pulse-wave modulation signal received by said switch.

14. The luminous flux control device as claimed in claim 13, wherein said switch is an n-type metal-oxide-semiconductor field-effect transistor having a drain terminal, a source terminal, and a gate terminal that serve as said first terminal, said second terminal, and said control terminal of said switch, respectively.

15. The luminous flux control device as claimed in claim 9, wherein the compensation voltage generated by said compensation voltage module satisfies $$VC=G1\times(Vref1-Vdet1)+Vref2$$

where VC represents the compensation voltage, G1 represents a gain of said compensation voltage module, Vref1 represents the first reference voltage, Vdet1 represents the first detection voltage, and Vref2 represents the second reference voltage.

16. The luminous flux control device as claimed in claim 9, wherein said second solid-state light-emitting is one of a light-emitting diode and a laser diode.

17. A luminous flux control circuit adapted to be connected to a first solid-state light-emitting component that has an anode and a cathode, one of which is disposed to receive an input voltage, and that has a first forward voltage when driven under a constant current condition, and a second solid-state light-emitting component that has an anode and a cathode, one of which is disposed to receive the input voltage, and that has a second forward voltage when driven under a constant current condition, said luminous flux control circuit comprising:

a detection module including a current source and a first instrumentation amplifier, said current source being adapted to be connected electrically to the other of the anode and the cathode of the second solid-state light-emitting component for providing a constant current through the second solid-state light-emitting component, said first instrumentation amplifier having first and second input terminals that are adapted to be connected electrically and respectively to the anode and the cathode of the second solid-state light-emitting component for detecting the second forward voltage, said first instrumentation amplifier being operable to generate a first detection voltage that has a magnitude dependent on the second forward voltage detected by said first instrumentation amplifier, and further having an output terminal for outputting the first detection voltage;

a compensation voltage module connected electrically to said output terminal of said first instrumentation amplifier for receiving the first detection voltage from said first instrumentation amplifier, disposed to receive a first reference voltage and a second reference voltage, and operable to generate a compensation voltage according to the first detection voltage, the first reference voltage, and the second reference voltage received by said compensation voltage module, the compensation voltage having a magnitude related to the second forward voltage; and a power control module connected electrically to said compensation voltage module for receiving the compensation voltage from said compensation voltage module, adapted to be connected electrically to the anode and the cathode of the first solid-state light-emitting component for detecting the first forward voltage, and operable to provide a driving current through the first solid-state light-emitting component, the driving current being dependent on the compensation voltage and the first forward voltage received and detected by said power control module and varying according to ambient temperature to stabilize luminous flux of the first solid-state light-emitting component.

18. The luminous flux control circuit as claimed in claim 17, wherein said power control module includes:

a voltage-to-current converting unit adapted to be connected electrically to the other of the anode and the cathode of the first solid-state light-emitting component, and operable to provide the driving current through the first solid-state light-emitting component according to a driving voltage received by said voltage-to-current converting unit, and to generate a feedback voltage according to the driving current provided thereby;

a second instrumentation amplifier having first and second input terminals that are adapted to be connected electrically and respectively to the anode and the cathode of the first solid-state light-emitting component for detecting the first forward voltage, operable to generate a second detection voltage that has a magnitude dependent on the first forward voltage detected by said second instrumentation amplifier, and further having an output terminal for outputting the second detection voltage;

a multiplier connected electrically to said output terminal of said second instrumentation amplifier for receiving the second detection voltage from said second instrumentation amplifier, connected electrically to said voltage-to-current converting unit for receiving the feedback voltage from said voltage-to-current converting unit, and operable to generate a product voltage based on a product of the second detection voltage and the feedback voltage received by said multiplier; and a driving voltage generating unit connected electrically to said compensation voltage module for receiving the compensation voltage from said compensation voltage module, connected electrically to said multiplier for receiving the product voltage from said multiplier, operable to generate the driving voltage according to a difference between the compensation voltage and the product voltage, and connected electrically to said voltage-to-current converting unit for providing the driving voltage to said voltage-to-current converting unit.

19. The luminous flux control circuit as claimed in claim 18, wherein said voltage-to-current converting unit includes:

a resistor;

a transistor having a first terminal adapted to be connected electrically to the other of the anode and the cathode of the first solid-state light-emitting component, a second terminal connected to ground via said resistor, and a control terminal, a voltage at said second terminal of said transistor serving as the feedback voltage; and an operational amplifier that has a first input terminal connected electrically to said driving voltage generating unit for receiving the driving voltage from said driving voltage generating unit, and a second input terminal connected electrically to said second terminal of said transistor for receiving the feedback voltage from said transistor, that is operable to generate a control voltage according to a difference between the driving voltage and the feedback voltage, and that further has an output terminal connected electrically to said control terminal of said transistor for outputting the control voltage to said transistor, such that said transistor is turned on to control provision of the driving current through the first solid-state light-emitting component via said transistor according to the control voltage received by said transistor.

20. The luminous flux control circuit as claimed in claim 19, wherein said transistor is an n-type metal-oxide-semiconductor field-effect transistor having a drain terminal, a source terminal, and a gate terminal that serve as said first terminal, said second terminal, and said control terminal of said transistor, respectively.

21. The luminous flux control circuit as claimed in claim 18, wherein said driving voltage generating unit includes:

a third instrumentation amplifier that has a first input terminal connected electrically to said compensation voltage module for receiving the compensation voltage from said compensation voltage module, and a second input terminal connected electrically to said multiplier for receiving the product voltage from said multiplier, that is operable to generate the driving voltage according to the compensation voltage and the product voltage received by said third instrumentation amplifier, and that has an output terminal for outputting the driving voltage;

a pulse-wave signal generator operable for generating a pulse-wave modulation signal; and a switch that has a first terminal connected electrically to said output terminal of said third instrumentation amplifier, a second terminal connected electrically to said voltage-to-current converting unit, and a control terminal connected electrically to said pulse-wave signal generator for receiving the pulse-wave modulation signal from said pulse-wave signal generator, such that said switch is turned on to control provision of the driving voltage from said output terminal of said third instrumentation amplifier to said voltage-to-current converting unit via said switch according to the pulse-wave modulation signal received by said switch.

22. The luminous flux control circuit as claimed in claim 21, wherein said switch is an n-type metal-oxide-semiconductor field-effect transistor having a drain terminal, a source terminal, and a gate terminal that serve as said first terminal, said second terminal, and said control terminal of said switch, respectively.

23. The luminous flux control circuit as claimed in claim 17, wherein the compensation voltage generated by said compensation voltage module satisfies $$VC=G1\times(Vref1-Vdet1)+Vref2$$

where VC represents the compensation voltage, G1 represents a gain of said compensation voltage module, Vref1 represents the first reference voltage, Vdet1 represents the first detection voltage, and Vref2 represents the second reference voltage.

* * * * *